US009047828B2

(12) United States Patent
Kim et al.

(10) Patent No.: US 9,047,828 B2
(45) Date of Patent: Jun. 2, 2015

(54) LIQUID CRYSTAL DISPLAY DEVICE INCLUDING SIGNAL CONTROLLERS FOR DRIVING PANEL AREAS AND METHOD FOR DRIVING THEREOF

(75) Inventors: Kyoung-Phil Kim, Cheonan-si (KR); Jae Wan Park, Seoul (KR); Jang-Hyun Yeo, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 862 days.

(21) Appl. No.: 13/240,085

(22) Filed: Sep. 22, 2011

(65) Prior Publication Data

US 2012/0249605 A1 Oct. 4, 2012

(51) Int. Cl.

| | |
|---|---|
| ***G09G 5/10*** | (2006.01) |
| ***G09G 3/34*** | (2006.01) |
| ***G09G 3/36*** | (2006.01) |

(52) U.S. Cl.

CPC ..... *G09G 3/342* (2013.01); *G09G 3/3406* (2013.01); *G09G 3/3611* (2013.01); *G09G 3/3666* (2013.01); *G09G 2320/0646* (2013.01); *G09G 2330/021* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 2009/0102776 | A1* | 4/2009 | Ko et al. | 345/94 |
| 2009/0109167 | A1* | 4/2009 | Park et al. | 345/102 |
| 2010/0060555 | A1 | 3/2010 | Lee et al. | |
| 2010/0214209 | A1 | 8/2010 | Seo et al. | |

FOREIGN PATENT DOCUMENTS

| | | | |
|---|---|---|---|
| JP | 2008-249780 | A | 10/2008 |
| JP | 2009-139931 | A | 6/2009 |
| JP | 2010-134421 | A | 6/2010 |
| KR | 10-2009-0039506 | A | 4/2009 |
| KR | 10-2009-0068591 | A | 6/2009 |
| KR | 10-2009-0073454 | A | 7/2009 |
| KR | 10-2009-0109766 | A | 10/2009 |
| KR | 10-2009-0109767 | A | 10/2009 |

* cited by examiner

*Primary Examiner* — Alexander S Beck
*Assistant Examiner* — Kirk Hermann
(74) *Attorney, Agent, or Firm* — Cantor Colburn LLP

(57) ABSTRACT

A liquid crystal display includes: a liquid crystal panel including a first region and a second region; a first signal controller which generates a first representative value representing image signals of the first region; a second signal controller which generates a second representative value representing image signals of the second region and transmits the second representative value to the first signal controller; a light source unit which irradiates light to the liquid crystal panel; and a light source driver which controls luminance of the light source unit. The first signal controller transmits a luminance of the light source unit to the light source driver. The luminance of the light source unit is calculated from the first representative value and the second representative value.

26 Claims, 6 Drawing Sheets

LIQUID CRYSTAL DISPLAY DEVICE INCLUDING SIGNAL CONTROLLERS FOR DRIVING PANEL AREAS AND METHOD FOR DRIVING THEREOF

This application claims priority to Korean Patent Application No. 10-2011-0027696 filed on Mar. 28, 2011, and all the benefits accruing therefrom under 35 U.S.C. §119, the entire contents of which are incorporated herein by reference.

BACKGROUND OF THE INVENTION (a) Field of the Invention

The invention relates to a liquid crystal display and a driving method thereof. More particularly, the invention relates to a liquid crystal display that is capable of being driven with dimming driving by considering data of an entire panel, and reducing a cost and steps of a driving method thereof.

(b) Description of the Related Art

A liquid crystal display is one of the most widely used flat panel displays. The liquid crystal display includes two display panels on which field generating electrodes such as a pixel electrode and a common electrode are formed, and a liquid crystal layer that is disposed therebetween, and shows an image by applying a voltage to a field generating electrode to generate an electric field on the liquid crystal layer, which determines alignment of liquid crystal molecules of the liquid crystal layer and controls polarization of incident light.

Since such a liquid crystal display is not self-emissive, a light source is required. In this case, the light source may be a separately provided artificial light source or a natural light source. The artificial light source used in the liquid crystal display includes a light emitting diode ("LED"), a cold cathode fluorescent lamp ("CCFL"), and an external electrode fluorescent lamp ("EEFL").

A dimming driving method that controls the amount of light of a light source considering luminance of an image in order to minimize power consumption and prevent reduction of contrast ratio ("CR") of the image has been developed.

Also, it is difficult to drive the liquid crystal display with one signal controller according to a recent trend of a high resolution and a high refresh rate of the panel such that a method using a plurality of signal controllers has been considered.

When driving the liquid crystal display by using a plurality of signal controllers, dimming driving considering the data of the entire panel is difficult.

Also, a light source driver is also required because of the number of the signal controllers such that the cost is increased.

The above information disclosed in this Background section is only for enhancement of understanding of the background of the invention and therefore it may contain information that does not form the prior art that is already known in this country to a person of ordinary skill in the art.

BRIEF SUMMARY OF THE INVENTION

The invention provides a liquid crystal display driving data of an entire panel with dimming driving, and a driving method thereof.

Also, the invention provides a liquid crystal display using one light source driver to reduce cost while using a plurality of signal controllers for the dimming driving, and a driving method thereof.

An exemplary embodiment of a liquid crystal display includes: a liquid crystal panel including a first region and a second region; a first signal controller which generates a first representative value representing image signals of the first region; a second signal controller which generates a second representative value representing image signals of the second region and transmits the second representative value to the first signal controller; a light source unit which irradiates light to the liquid crystal panel; and a light source driver which controls luminance of the light source unit. The first signal controller transmits a luminance of the light source unit to the light source driver. The luminance of the light source unit is calculated from the first representative value and the second representative value.

In an exemplary embodiment, the first signal controller may calculate the luminance of the light source unit from the first representative value and the second representative value.

In an exemplary embodiment, the light source unit may include a first light source unit irradiating the light to the first region, and a second light source unit irradiating the light to the second region.

In an exemplary embodiment, the first signal controller may calculate the luminance of the first light source unit from the first representative value, and the luminance of the second light source unit from the second representative value.

In an exemplary embodiment, the first signal controller may calculate the luminance of the first light source unit from the first representative value, and the second signal controller may calculate the luminance of the second light source unit from the second representative value and transmit the calculated luminance of the second light source unit to the first signal controller.

In an exemplary embodiment, the liquid crystal display may further include: a first data driver which converts an image signal of the first region into a first data voltage and supplies the first data voltage to the first region of the liquid crystal panel; and a second data driver which converts an image signal of the second region into a second data voltage and supplies the second data voltage to the second region of the liquid crystal panel.

In an exemplary embodiment, the first representative value may be at least one among a maximum value and an average value of the image signals of the first region, and the second representative value may be at least one among a maximum value and an average value of the image signals of the second region.

In an exemplary embodiment, the liquid crystal display may include a plurality of second signal controllers. The second region of the liquid crystal display panel may include a plurality of subregions. The plurality of second signal controllers may generate and transmit sub-representative values representing image signals of the plurality of subregions to the first signal controller.

In an exemplary embodiment, the second signal controller may be in unidirectional communication with the first signal controller.

In an exemplary embodiment, the first signal controller may calculate a luminance of the first region and a luminance of the second region, compensate the image signals of the first region and the image signals of the second region in consideration of the calculated luminance of the first region and the second region, respectively, generate compensated image signals of the first region and compensated image signals of the second region, and transmit the compensated image signals of the second region to the second signal controller.

In an exemplary embodiment, the first signal controller and the second signal controller may be in bidirectional communication with each other.

In an exemplary embodiment, the first signal controller and the second signal controller may use an inter-integrated circuit ("I2C") method of communication.

An exemplary embodiment of a driving method of a liquid crystal display includes: a first signal controller generating a first representative value representing image signals of a first region of a liquid crystal display panel; a second signal controller generating and transmitting a second representative value representing image signals of a second region of the liquid crystal display panel, to the first signal controller; calculating luminance of a light source unit which irradiates light to the liquid crystal panel, from the first representative value and the second representative value; and driving the light source unit.

In an exemplary embodiment, in the calculating luminance of a light source unit, the first signal controller may calculate the luminance of the light source unit.

In an exemplary embodiment, the light source unit may include a first light source unit and a second light source unit. In the driving the light source unit, the first light source unit may irradiate light to the first region, and the second light source unit may irradiate light to the second region.

In an exemplary embodiment, in the calculating luminance of a light source unit, the first signal controller may calculate the luminance of the first light source unit from the first representative value, and the luminance of the second light source unit from the second representative value.

In an exemplary embodiment, the calculating luminance of a light source unit may include: the first signal controller calculating the luminance of the first light source unit from the first representative value; and the second signal controller calculating the luminance of the second light source unit from the second representative value and transmitting the calculated luminance of the second light source unit to the first signal controller.

In an exemplary embodiment, the driving method may further include converting an image signal of the first region into a first data voltage and supplying the first data voltage to the first region of the liquid crystal panel; and converting an image signal of the second region into a second data voltage and supplying the second data voltage to the second region of the liquid crystal panel.

In an exemplary embodiment, in the first signal controller generating a first representative value, at least one of a maximum value and an average value of the image signals of the first region may be generated as the first representative value, and in the second signal controller generating a second representative value, at least one of a maximum value and an average value of the image signals of the second region may be generated as the second representative value.

In an exemplary embodiment, the second region of the liquid crystal panel may include a plurality of subregions, a plurality of second signal controllers are connected to the first signal controller, and in the second signal controller generating a second representative value, the plurality of second signal controllers may generate sub-representative values representing image signals of the plurality of subregions and transmit the sub-representative values to the first signal controller.

In an exemplary embodiment, in the second signal controller generating a second representative value, the second signal controller may transmit the second representative value to the first signal controller with unidirectional communication.

In an exemplary embodiment, the driving method may further include: calculating a luminance of the first region and a luminance of the second region; compensating the image signals of the first region and the image signals of the second region in consideration of the calculated luminance of the first region and the second region; generating compensated image signals of the first region and compensated image signals of the second region; and transmitting the compensated image signals of the second region to the second signal controller.

In an exemplary embodiment, the driving method may further include: converting the compensated image signals of the first region into compensated first data voltages and supplying the compensated first data voltages to the first region of the liquid crystal panel; and converting the compensated image signals of the second region into compensated second data voltages and supplying the compensated second data voltages to the second region of the liquid crystal panel.

In an exemplary embodiment, the first signal controller and the second signal controller may exchange the second representative value and the compensated image signal of the second region with bidirectional communication.

In an exemplary embodiment, the first signal controller and the second signal controller may use an I2C method of communication.

In an exemplary embodiment, the first signal controller generating a first representative value, the second signal controller generating and transmitting a second representative value, the calculating luminance of a light source unit and the driving the light source unit may be executed in a vertical blank period.

The above-described liquid crystal display and driving method have effects as follows.

In exemplary embodiments of the liquid crystal display and the driving method according to the invention, a plurality of signal controllers generates the representative values of each region of a display panel and transmit the representative values to one signal controller for dimming driving of the light source. Thereby the dimming driving may be executed in consideration of the data of the entire display panel.

Also, in exemplary embodiments of the liquid crystal display and the driving method according to the invention, the dimming driving is executed by using a plurality of signal controllers and one light source driver such that a liquid crystal display with high resolution and a high refresh rate may be realized through a low cost.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION OF THE INVENTION

Figure 1:
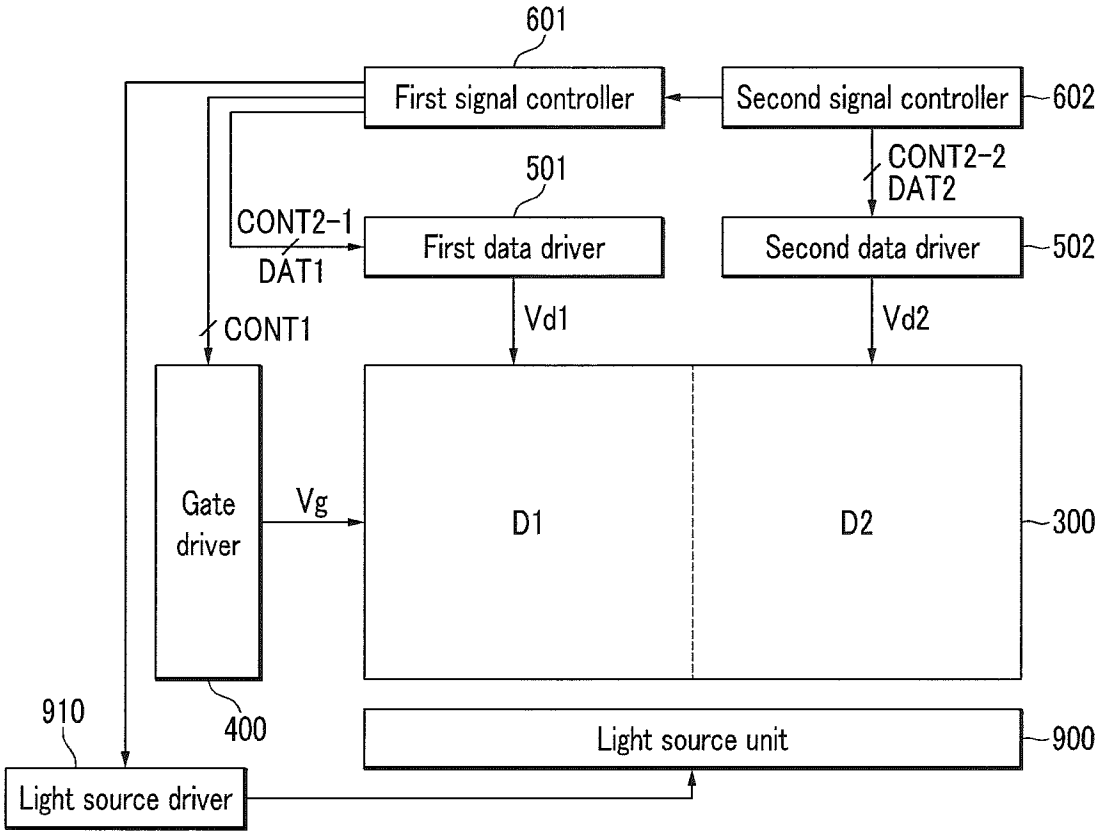
FIG. 1 is a block diagram of an exemplary embodiment of a liquid crystal display according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be described in detail with reference to the accompanying drawings.

Firstly, an exemplary embodiment of a liquid crystal display according to the invention will be described with accompanying drawings.

FIG. 1 is a block diagram of an exemplary embodiment of a liquid crystal display according to the invention.

The exemplary embodiment of the liquid crystal display includes a liquid crystal panel 300, a light source unit 900 generating and irradiating light to the liquid crystal panel 300, a light source driver 910 controlling luminance of the light source unit 900, and a first signal controller 601 and a second signal controller 602 controlling signals applied to the liquid crystal panel 300 and the light source driver 910.

The liquid crystal panel 300 includes two substrates facing each other with a liquid crystal layer therebetween. One substrate of the two substrates includes a gate line and a data line that intersect each other. The liquid crystal panel 300 may include a plurality of gate lines and a plurality of data lines. The liquid crystal panel 300 is divided into a first region D1 and a second region D2. Each of the first region D1 and the second region D2 may include a data line or may include a plurality of data lines.

A gate driver 400, a first data driver 501, and a second data driver 502 are connected to the liquid crystal panel 300.

The gate driver 400 is connected to the gate line of the liquid crystal panel 300, and applies a gate voltage Vg of a combination of a gate-on voltage and a gate-off voltage to the gate line.

The first data driver 501 is connected to the data line of the first region D1 of the liquid crystal panel 300, and applies a first data voltage Vd1 to the data line of the first region D1.

The second data driver 502 is connected to the data line of the second region D2 of the liquid crystal panel 300, and applies a second data voltage Vd2 to the data line of the second region D2.

The first signal controller 601 and the second signal controller 602 receive input image signals, and input control signals controlling the display thereof such as a vertical synchronization signal and a horizontal synchronizing signal, a main clock signal, and a data enable signal from an external graphics controller (not shown).

The first signal controller 601 appropriately processes an input image signal to be suitable for the operation condition of the liquid crystal panel 300 on the basis of the input image signal and an input control signal, and generates a gate control signal CONT1 and a first data control signal CONT2-1, and then outputs the gate control signal CONT1 to the gate driver 400, and the first data control signal CONT2-1 and a processed first image signal DAT1 to the first data driver 501.

The second signal controller 602 appropriately processes an input image signal to be suitable for the operation condition of the liquid crystal panel 300 on the basis of the input image signal and the input control signal, and generates a second data control signal CONT2-2, and then outputs the second data control signal CONT2-2 and a processed second image signal DAT2 to the second data driver 502.

Also, the first signal controller 601 generates a first representative value representing the first image signals DAT1 as an image signal of the first region D1, and the second signal controller 602 generates a second representative value representing the second image signals DAT2 as an image signal of the second region D2. The first representative value and the second representative value are values representing the luminance of the first region D1 and the second region D2.

The second signal controller 602 transmits the generated second representative value to the first signal controller 601. Here, one-sided data transmission is executed from the second signal controller 602 to the first signal controller 601 such that unidirectional communication may be used.

The first signal controller 601 calculates the luminance of the light source unit 900 from the first representative value and the second representative value. In the illustrated exemplary embodiment, the luminance of the light source unit 900 is set to be high in a case that the first and second representative values are high, and the luminance of the light source unit 900 is set to be low in a case that the first and second representative values are low.

The first signal controller 601 determines the brightness of the light provided to the entire liquid crystal panel 300 by considering the first image signals DAT1 of the first region D1 and the second image signals DAT2 of the second region D2. Accordingly, the dimming driving is executed by two signal controllers 601 and 602 such that the driving is efficient and the dimming driving considering the entire liquid crystal panel 300 is possible.

The first image signal DAT1 and the second image signal DAT2 represent the luminance of the pixels of the liquid crystal panel 300, and may have a value of 0 to 255. 0 means a black gray in which the luminance is lowest, and 255 means a white gray in which the luminance is highest.

When the number of image signals having low luminance values is increased, a screen is dark, and when the number of image signals having high luminance values is increased, the screen is bright. Here, the light source unit 900 must be driven at 100% in the frame in which the image signal has the highest value, however the desired screen is displayed while driving the light source unit 900 at less than 100% in the frame expressing a further darker screen such that the power consumption may be reduced.

Accordingly, the representative values of the image signals expressing the luminance of the corresponding frame may be generated and the luminance of the light source unit may be controlled according to the representative values. The representative values may be generated as the maximum value, or the average value of the luminance values corresponding to the image signals of the corresponding region of the corresponding frame.

When a maximum value of image signals is used as a representative value, luminance of the light source unit 900 is controlled corresponding to the maximum value so that all the values in the corresponding region of the corresponding frame can be properly represented, but the power consumption is reduced insignificantly. That is, luminance of the light source unit 900 is determined corresponding to a portion having high luminance not only in a wholly bright screen but also in a wholly dark screen.

When an average value of image signals is used as a representative value, luminance of the light source unit 900 is controlled to be relatively low compared to the case that the maximum value is used as the representative value, and therefore values having high luminance in the corresponding region of the corresponding frame cannot be properly represented. However, in case the screen is dark and partially bright, luminance of the light source unit 900 is adjusted to an average luminance value of the screen so that the power consumption can be significantly reduced.

The light source unit 900 may include light sources such as a light emitting diode ("LED"), a cold cathode fluorescent lamp ("CCFL"), and an external electrode fluorescent lamp ("EEFL") to generate and irradiate the light to the liquid crystal panel 300.

The light source unit 900 is classified into a perpendicular irradiation type and a side irradiation type. The perpendicular irradiation type is right below and overlapping the liquid crystal panel 300, and directly irradiates light thereto. The side irradiation type irradiates light through a light guiding plate to the liquid crystal panel 300. Either of the two types may be applied to the light source unit 900. The light source unit 900 supplies the light inside the liquid crystal panel 300, and the supplied light is emitted outside the liquid crystal panel 300 to be displayed on the screen.

The light source driver 910 receives signals having the information for the luminance of the light source unit 900 from the first signal controller 601 to control the luminance and drive the light source unit 900. That is, the light source unit 900 is driven at 100% in the frame expressing the brightest screen, and the light source unit 900 is driven with a gradually smaller ratio as the screen becomes darker.

The dimming driving method includes global dimming, one dimensional ("1-D") local dimming, two dimensional ("2-D") local dimming, three-way dimming, and boosting. The global dimming targets the whole screen. According to the 1-D local dimming, the screen is divided with reference to one of the vertical axis and the horizontal axis. According to the 2-D local dimming, the screen is divided by the X-axis and the Y-axis. The 3-way dimming performs dimming including location and color information. The boosting enhances luminance for a specific image for optimizing emotional image quality such as adaptive luminance and power control ("ALPC"). In the illustrated exemplary embodiment, the case of applying the global dimming driving method is described.

The illustrated exemplary embodiment includes two signal controllers respectively generating the representative values representing the image signals of two regions of the liquid crystal panel 300, however the invention is not limited thereto and more than two signal controllers may be included.

In one exemplary embodiment, for example, the second region D2 of the liquid crystal panel 300 may include a plurality of subregions, and there may be multiple second signal controllers 602, respectively. Here, the number of second signal controllers 602 may correspond to the number of the plurality of subregions. The second signal controller 602 generates sub-representative values representing the image signals of each subregion and transmits the sub-representative values to the first signal controller 601. Accordingly, the first signal controller 601 gathers the information for the image signals of the entire liquid crystal panel 300 and processes the dimming driving in consideration of this information for the entire liquid crystal panel 300.

Next, another exemplary embodiment of a liquid crystal display according to the invention will be described with reference to accompanying drawings.

As a largest difference from the exemplary embodiment illustrated in FIG. 1, a local dimming driving method is applied in the illustrated exemplary embodiment, and will be described in detail.

Figure 2:
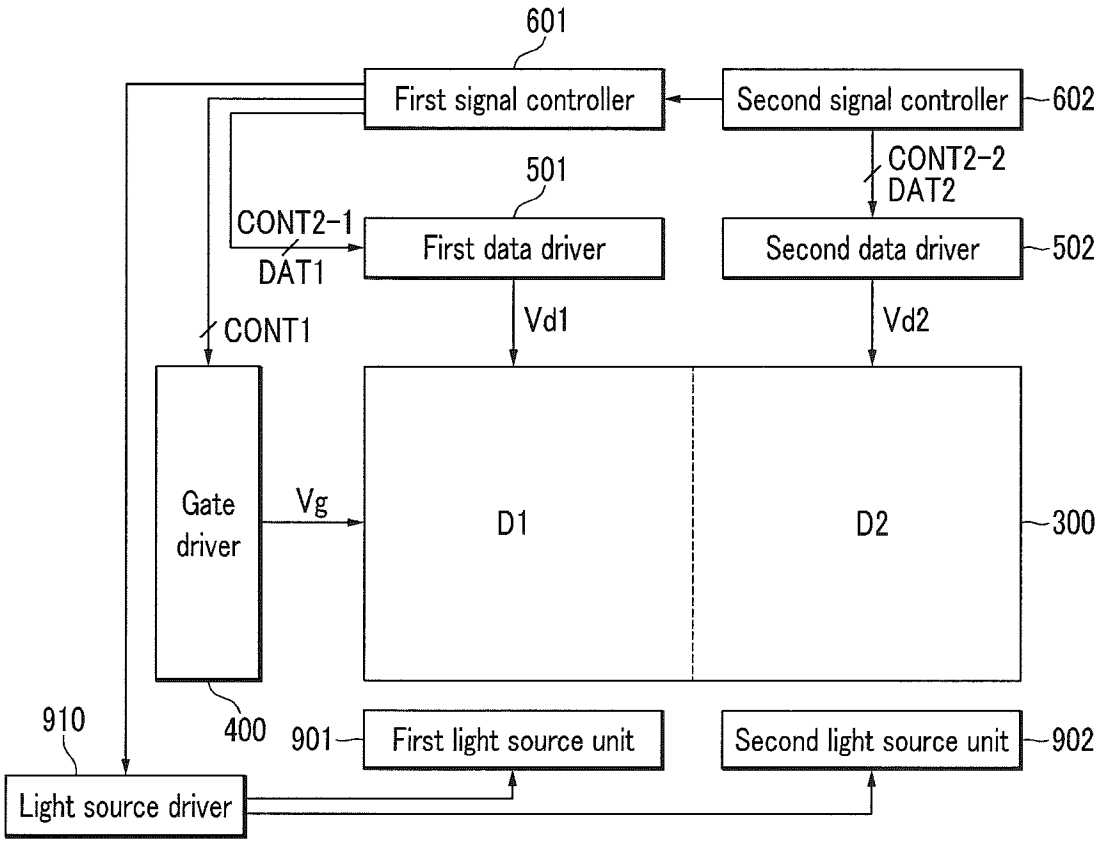
FIG. 2 is a block diagram of another exemplary embodiment of a liquid crystal display according to the invention.

FIG. 2 is a block diagram of another exemplary embodiment of a liquid crystal display according to the invention.

The illustrated exemplary embodiment of the liquid crystal display is substantially the same as the liquid crystal display illustrated in FIG. 1 such that overlapping description thereof is omitted and the differences will be described.

The exemplary embodiment of the liquid crystal display includes the liquid crystal panel 300, the light source driver 910, the first signal controller 601, and the second signal controller 602 like the liquid crystal display in the exemplary embodiment of FIG. 1.

The liquid crystal display of the exemplary embodiment in FIG. 1 includes the single light source unit 900, but the illustrated exemplary embodiment in FIG. 2 includes a first light source unit 901 and a second light source unit 902.

In the exemplary embodiment of FIG. 1, the global dimming driving is applied to provide light of the same luminance to the entire liquid crystal panel 300. However the exemplary embodiment of FIG. 2 applies the local dimming driving to provide light of different luminance to the first region D1 and the second region D2 of the liquid crystal panel 300.

The first signal controller 601 generates the first representative value representing the first image signals DAT1 as the image signal of the first region D1, and the second signal controller 602 generates the second representative value representing the second image signals DAT2 as the image signal of the second region D2.

The second signal controller 602 transmits the generated second representative value to the first signal controller 601. Here, the one-sided data transmission is processed from the second signal controller 602 to the first signal controller 601 such that the unidirectional communication is used.

The first signal controller 601 may calculate the luminance of the first light source unit 901 from the first representative value and the luminance of the second light source unit 902 from the second representative value. The luminance of the first light source unit 901 is set up according to the magnitude of the first representative value, and the luminance of the second light source unit 902 is set up according to the magnitude of the second representative value, independent from the first representative value. That is, if the magnitudes of the first representative value and the second representative value are different from each other, the luminance of the first light source unit 901 and the second light source unit 902 are set up to be different from each other. Accordingly, when the image of a corresponding region is darker than the image of an adjacent region, the light source unit of the corresponding region is driven with lower luminance further decreasing the power consumption.

Alternatively, the first signal controller 601 may calculate the luminance of the first light source unit 901 from the first representative value, and the second signal controller 602 may calculate the luminance of the second light source unit 902 from the second representative value. The second signal controller 602 calculates the luminance of the second light source unit 902 and then transmits it to the first signal controller 601. Here, the one-sided data transmission is executed from the second signal controller 602 to the first signal controller 601 such that the unidirectional communication is used.

In the illustrated exemplary embodiment, the liquid crystal display includes two light source units to provide the different luminance to two regions of the liquid crystal panel 300. However the invention is not limited thereto such that more than two light source units may be provided, and the liquid crystal panel 300 may be divided with more than two regions and the different luminance may be provided to each region. Here, one signal controller may generate the representative value of the image signal of more than two regions.

Also, more than two signal controllers may be provided, and furthermore may be provided in the same number as the light source units such that one signal controller may generate the representative value of the image signal of one region.

Next, still another exemplary embodiment the liquid crystal display according to the invention will be described with reference to accompanying drawings.

As the largest difference from the exemplary embodiment illustrated in FIG. 2, values of the image signals are compensated in the illustrated exemplary embodiment to generate new signals and to provide them to each data driver, and will be described.

Figure 3:
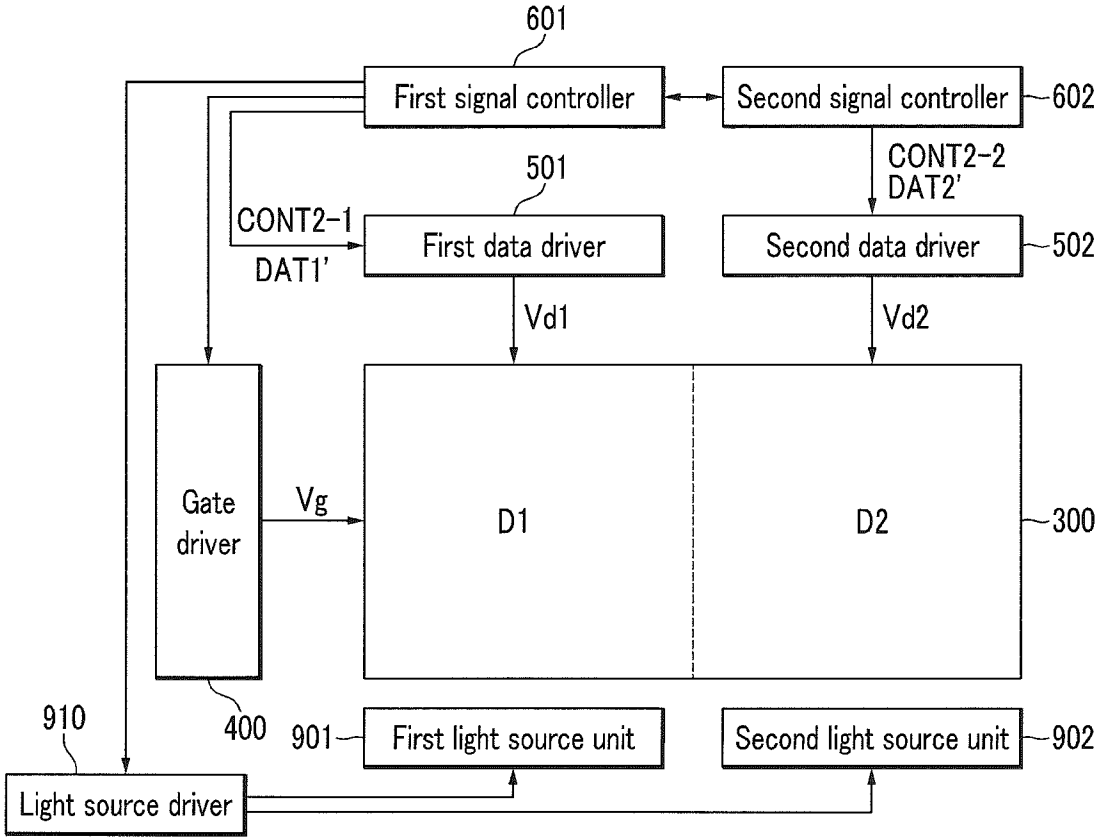
FIG. 3 is a block diagram of still another exemplary embodiment of a liquid crystal display according to the invention.

FIG. 3 is a block diagram of still another exemplary embodiment of a liquid crystal display according to the invention.

The illustrated exemplary embodiment of the liquid crystal display is substantially the same as the liquid crystal display illustrated in FIG. 2 such that overlapping description thereof is omitted and the differences will be described.

The exemplary embodiment of the liquid crystal display includes the liquid crystal panel 300, the light source driver 910, the first signal controller 601, the second signal controller 602, the first light source unit 901, and the second light source unit 902 like the liquid crystal display according to the exemplary embodiment of FIG. 2.

However, in the exemplary embodiment of FIG. 3, the value of the image signal may be changed and compensated in consideration of the change of the luminance of the first light source unit 901 and the second light source unit 902. When the luminance of the first light source unit 901 and the second light source unit 902 is driven to be lower than 100%, if the first image signal DAT1 and the second image signal DAT2 are output to the first data driver 501 and the second data driver 502 like in the exemplary embodiment of FIG. 2, the luminance is represented to be more dark. Accordingly, in consideration of the decreasing of the intensity of the light source, the values of the first image signal DAT1 and the second image signal DAT2 are compensated for a large amount of light to be passed and output to the first data driver 501 and the second data driver 502.

In detail, after the first signal controller 601 calculates the luminance of the first light source unit 901 from the first representative value, the first signal controller 601 generates the compensated first image signal DAT1' in consideration of the degree that the luminance of the first light source unit 901 is decreased. Also, after the first signal controller 601 calculates the luminance of the second light source unit 902 from the second representative value, the first signal controller 601 generates the compensated second image signal DAT2' in consideration of the degree that the luminance of the second light source unit 902 is decreased.

Also, the light sources of two regions are both influenced in the region neighboring the boundary of the first region D1 and the second region D2 such that the value of the first image signal DAT1 and the second image signal DAT2 is compensated.

The first signal controller 601 transmits the compensated second image signal DAT2' to the second signal controller 602, and the first signal controller 601 and the second signal controller 602 respectively output the compensated first image signal DAT1' and the compensated second image signal DAT2' to the first data driver 501 and the second data driver 502.

The first signal controller 601 and the second signal controller 602 compensate and output the image signal such that an image close to the original desired image may be realized while driving the first light source unit 901 and the second light source unit 902 with the low power consumption.

In the illustrated exemplary embodiment, the second signal controller 602 generates the second representative value and transmits it to the first signal controller 601, and the first signal controller 601 transmits the compensated second image signal DAT2' to the second signal controller 602. That is, the first signal controller 601 and the second signal controller 602 exchange the data between each other such that bidirectional communication may be used. In one exemplary embodiment, for example, the first signal controller 601 and the second signal controller 602 may use the communication of an inter-integrated circuit ("I2C") method.

In the illustrated exemplary embodiment, two light source units are described like in the exemplary embodiment of FIG. 2, however the invention is not limited thereto, and the liquid crystal display may include one light source unit to provide the light of the same luminance to the entire screen like the exemplary embodiment in FIG. 1.

Next, an exemplary embodiment of a driving method of a liquid crystal display according to the invention will be described with reference to accompanying drawings.

Figure 4:
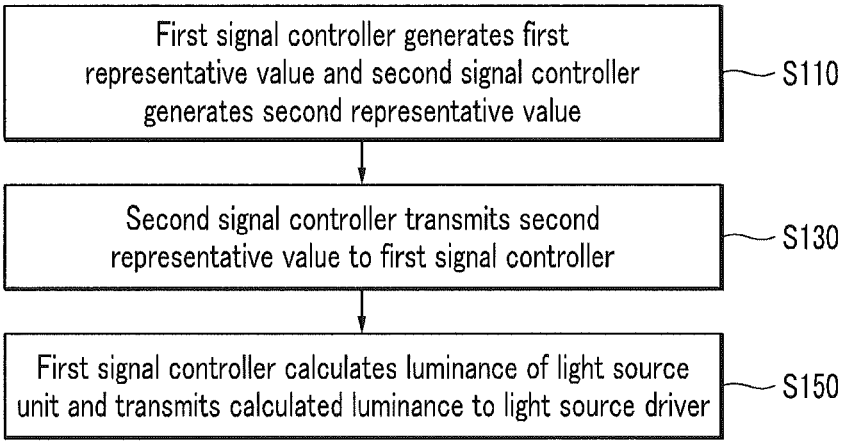
FIG. 4 is a flowchart of an exemplary embodiment of a driving method of a liquid crystal display according to the invention.

FIG. 4 is a flowchart of an exemplary embodiment of a driving method of a liquid crystal display according to the invention.

In the exemplary embodiment of the driving method of the liquid crystal display according to the invention, the first signal controller generates the first representative value representing the first image signals as the image signal of the first region of the liquid crystal panel which includes the first region and the second region, and the second signal controller generates the second representative value representing the second image signals as the image signal of the second region. (S110)

The representative values generated in the first signal controller or the second signal controller will be described with reference to FIG. 5.

Figure 5:
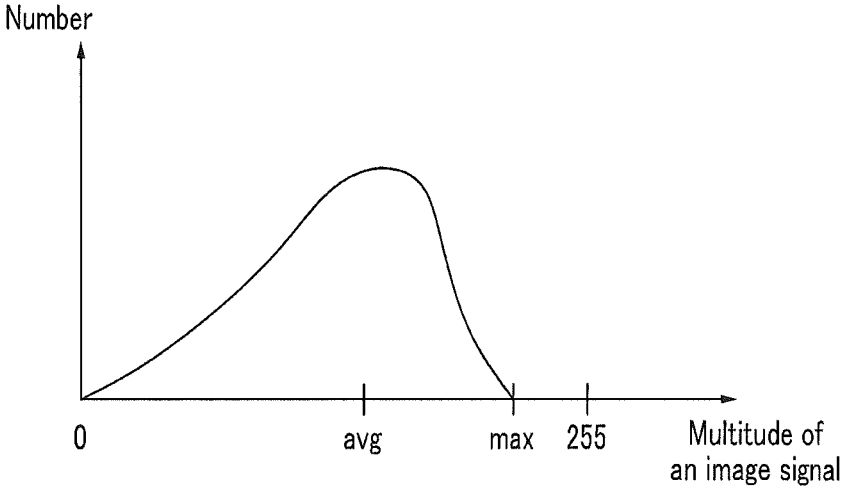
FIG. 5 is a graph showing a distribution of image signals in one frame.

FIG. 5 is a graph showing a distribution of image signals in one frame.

The transverse axis shows the magnitude of the image signals meaning the luminance of the pixels of the liquid crystal panel. The image signals may have a value from 0 to 255. 0 implies a black gray having the lowest luminance, and 255 implies a white gray having the highest luminance. That is, as the gray is closer to 0, the gray represents a darker gray, and as the gray is closer to 255, the gray represents a brighter gray. The longitudinal axis shows the number of image signals of the corresponding magnitude.

Referring to the image signals shown in FIG. 5, there are image signals expressing the very dark grays close to 0 and there are no image signals expressing the very bright gray close to 255. In contrast, there are many image signals entirely expressing the bright gray in the image signals expressing the middle gray. The maximum value 'max' and the average value 'avg' among the image signals in one frame may be the representative value representing the image signals. Also, the value between the maximum value 'max' and the average value 'avg' may be the representative value.

Also in S110, the first signal controller outputs the gate control signal to the gate driver, and the first data control signal and the first image signal to the first data driver. The second signal controller outputs the second data control signal and the second image signal to the second data driver.

Next, the second signal controller transmits the second representative value of the second image signal to the first signal controller. (S130)

The data transmission from the second signal controller to the first signal controller is processed, however the data transmission from the first signal controller to the second signal controller is not processed such that the unidirectional communication is used.

Next, the first signal controller calculates the luminance of the light source unit from the first representative value and the second representative value, and transmits the calculated luminance to the light source driver. (S150)

When the first and second representative values are high, the luminance of the light source unit is set to be high and the screen of the corresponding frame is bright. In contrast, when the first and second representative values are low, the luminance of the light source unit is set to be low and the screen of the corresponding frame is.

Here, the first signal controller determines the brightness of the light provided to the entire liquid crystal panel in consideration of the magnitude of the image signals of the entire region of the corresponding frame. Accordingly, the dimming driving is executed by using two signal controllers such that the driving is efficient and the dimming driving considering the entire liquid crystal panel is possible.

The light source driver drives the light source unit according to the luminance value of the light source unit transmitted from the first signal controller. The light source unit is driven at 100% in the frame in which the brightest screen is represented, and the light source unit is driven with a smaller ratio as the darker screen appears.

The illustrated exemplary embodiment includes two signal controllers generating the representative values representing the image signal of two regions of the liquid crystal panel. However, the invention is not limited thereto, and two or more signal controllers may be provided, and/or the liquid crystal panel may include two or more regions to generate the representative value representing the image signal of each region where the representative values are transmitted to one signal controller.

The calculation and the communication of S110 to S150 may be executed in a vertical blank period in which the data input of one frame is finished. The calculation and the communication are only executed in the vertical blank period such that other data for the signal controller may be transmitted and received in the remaining period. Also, the time difference of the data of the corresponding frame and the luminance of the light source unit reflecting the data may be minimized.

Next, another exemplary embodiment of a driving method of a liquid crystal display according to the invention will be described with reference to accompanying drawings.

Figure 6:
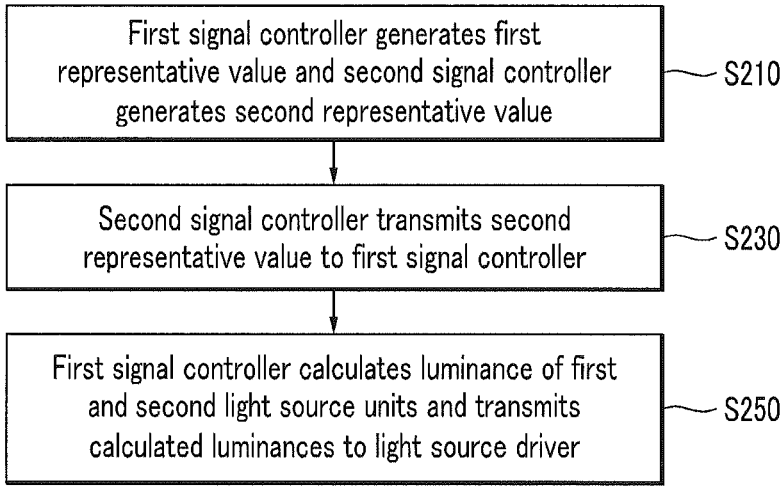
FIG. 6 is a flowchart of another exemplary embodiment of a driving method of a liquid crystal display according to the invention.

FIG. 6 is a flowchart of another exemplary embodiment of a driving method according to the invention.

The another exemplary embodiment of the driving method of the liquid crystal display is substantially the same as the driving method of the liquid crystal display of FIG. 4 such that overlapping description thereof is omitted and the difference will be described.

Firstly, the first signal controller generates the first representative value representing the first image signals as the image signal of the first region of the liquid crystal panel which includes the first region and the second region, and the second signal controller generates the second representative value representing the second image signals as the image signal of the second region. (S210)

Next, the second signal controller transmits the second representative value of the second image signal to the first signal controller. (S230)

S210 and S230 are executed as S110 and S130 in the exemplary embodiment of FIG. 4.

Next, the first signal controller calculates the luminance of the first light source unit from the first representative value and the luminance of the second light source unit from the second representative value, and transmits the calculated luminances to the light source driver. (S250)

In the exemplary embodiment of FIG. 4, the magnitude of the light provided to the entire region of the liquid crystal panel is set up in the corresponding frame in consideration of both the first representative value and the second representative value. However, in the exemplary embodiment of FIG. 6, the luminance of the first light source unit providing the light to the first region of the liquid crystal panel is set up according to the magnitude of the first representative value, and the luminance of the second light source unit providing the light to the second region of the liquid crystal panel is set up according to the magnitude of the second representative value independently from the first representative value. That is, when the first representative value and the second representative value have different magnitudes, the first region and the second region are provided with light of different magnitudes. Accordingly, when the image of the corresponding region is darker than the image of the adjacent region, the light source unit of the corresponding region is driven with the lower luminance further decreasing the power consumption.

In the illustrated exemplary embodiment, the first signal controller calculates the luminance of the first light source unit and the second light source unit, however the invention is not limited thereto. Alternatively, the first signal controller may calculate the luminance of the first light source unit from the first representative value and the second signal controller may calculate the luminance of the second light source unit from the second representative value. The second signal controller calculates the luminance of the second light source unit and transmits the calculated luminance to the first signal controller, and the first signal controller transmits the information for the calculated luminance of the second light source unit to the light source driver.

Here, the data transmission from the second signal controller to the first signal controller is executed, however the data transmission from the first signal controller to the second signal controller is not executed such that the unidirectional communication is used.

Also, the illustrated exemplary embodiment includes two light source units to provide light of different luminance to two regions of the liquid crystal panel. However the invention is not limited thereto, and two or more light source units may be included, and the liquid crystal panel may be divided into two or more regions to provide the light of different luminance to each region. Here, one signal controller generates the representative value of the image signal of two or more regions.

Also, two or more signal controllers may be used, corresponding to the number of light source units such that one signal controller may generate the representative value of the image signal of one region.

Next, still another exemplary embodiment of a driving method of a liquid crystal display according to the invention will be described with reference to accompanying drawings.

Figure 7:
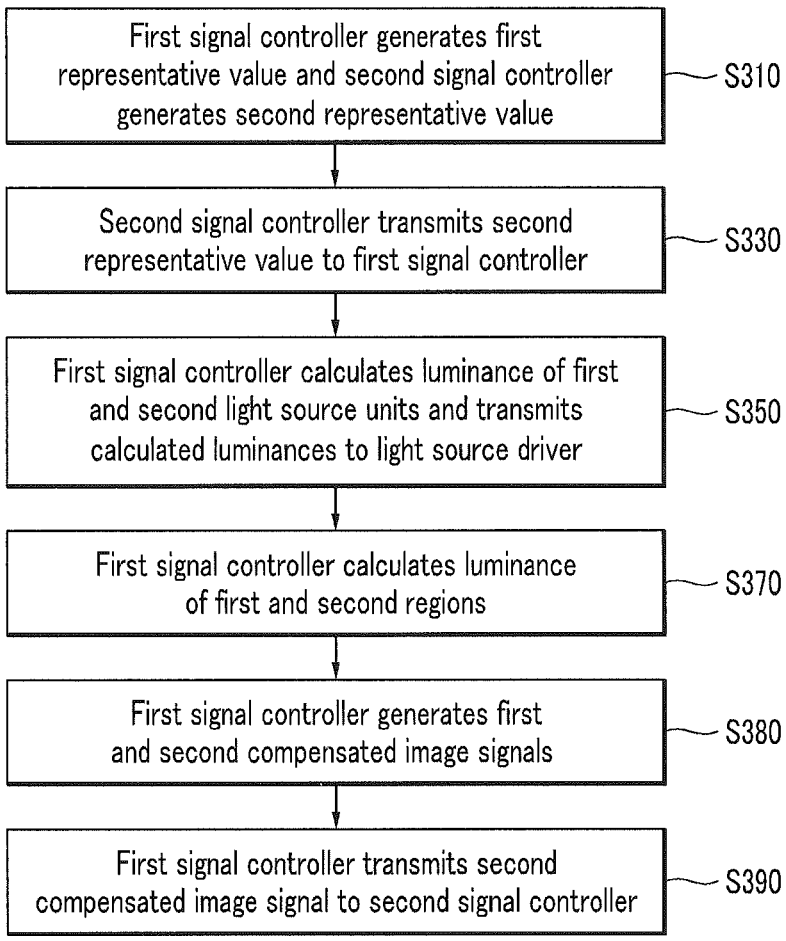
FIG. 7 is a flowchart of still another exemplary embodiment of a driving method of a liquid crystal display according to the invention.

FIG. 7 is a flowchart of still another exemplary embodiment of a driving method of a liquid crystal display according to the invention.

The still another exemplary embodiment of the driving method of the liquid crystal display is substantially the same as the driving method of the liquid crystal display of FIG. 6 such that overlapping description thereof is omitted and the difference will be described.

Firstly, the first signal controller generates the first representative value representing the first image signals as the image signal of the first region of the liquid crystal panel which includes the first region and the second region, and the second signal controller generates the second representative value representing the second image signals as the image signal of the second region. (S310)

Next, the second signal controller transmits the second representative value of the second image signal to the first signal controller. (S330)

Next, the first signal controller calculates the luminance of the first light source unit from the first representative value and the luminance of the second light source unit from the second representative value, and transmits the calculated luminances to the light source driver. (S350)

S310 to S350 are executed as S210 to S250 in the exemplary embodiment of FIG. 5.

Next, the first signal controller calculates the luminance of the first region and the luminance of the second region. (S370)

When the luminance of the first light source unit and the second light source unit is driven to be less than 100%, if the first image signal and the second image signal are output to the first data driver and the second data driver, the actual screen is displayed dark. Also, the first light source unit and the second light source unit are both influenced in the region adjacent to the boundary of the first region and the second region of the liquid crystal panel.

If the luminance of the first region and the luminance of the second region are calculated in consideration of this point, a luminance difference is generated for each pixel, different from the case of driving both the first light source unit and the second light source unit with the luminance of 100%.

To compensate this difference, the first signal controller generates the compensated first image signal and the compensated second image signal. (S380)

The first signal controller compensates the values of the first image signal and the second image signal in consideration of the decreasing intensity of the light source. That is, the compensated first image signal and the compensated second image signal are generated by considering the degree that the luminance of the first and second light source units are decreased, and the degree that the first and second light source units are affected by the adjacent region.

Next, the first signal controller transmits the compensated second image signal to the second signal controller. (S390)

The first signal controller outputs the compensated first image signal to the first data driver, and the second signal controller outputs the compensated second image signal transmitted from the first signal controller, to the second data driver.

When driving the liquid crystal panel by the compensated image signals, the decreased luminance is compensated such that an image close to the desired image may be realized.

In S330 of the illustrated exemplary embodiment, the second signal controller generates the second representative value and transmits it to the first signal controller, and in S390, the first signal controller transmits the compensated second image signal to the second signal controller. That is, the first signal controller and the second signal controller exchange the data between each other such that the bidirectional communication may be used. In one exemplary embodiment, for example, the first signal controller and the second signal controller may use the I2C method communication.

In the illustrated exemplary embodiment, two light source units are described like in the exemplary embodiment of FIG. 6, however the invention is not limited thereto, and the liquid crystal display may include one light source unit to provide light of the same luminance like the exemplary embodiment in FIG. 4.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display comprising:

a liquid crystal panel including a first region and a second region different from the first region;

a first signal controller which generates a first representative value representing image signals of only the first region of the liquid crystal panel;

a second signal controller which generates a second representative value representing image signals of only the second region of the liquid crystal panel, and transmits the second representative value to the first signal controller;

a light source unit which irradiates light to the liquid crystal panel; and a light source driver which controls luminance of the light source unit, wherein the first signal controller transmits a luminance of the light source unit to the light source driver, the luminance of the light source unit calculated from the first representative value and the second representative value.

2. The liquid crystal display of claim 1, wherein the first signal controller calculates the luminance of the light source unit from the first representative value and the second representative value.

3. The liquid crystal display of claim 1, wherein the light source unit includes:

a first light source unit which irradiates the light to the first region of the liquid crystal panel; and a second light source unit which irradiates the light to the second region of the liquid crystal panel.

4. The liquid crystal display of claim 3, wherein the first signal controller calculates the luminance of the first light source unit from the first representative value, and the luminance of the second light source unit from the second representative value.

5. The liquid crystal display of claim 3, wherein the first signal controller calculates the luminance of the first light source unit from the first representative value, and the second signal controller calculates the luminance of the second light source unit from the second representative value, and transmits the calculated luminance of the second light source unit to the first signal controller.

6. The liquid crystal display of claim 1, further comprising:

a first data driver which converts an image signal of the first region into a first data voltage and supplies the first data voltage to the first region of the liquid crystal panel; and a second data driver which converts an image signal of the second region into a second data voltage and supplies the second data voltage to the second region of the liquid crystal panel.

7. The liquid crystal display of claim 1, wherein the first representative value is at least one among a maximum value and an average value of the image signals of the first region, and the second representative value is at least one among a maximum value and an average value of the image signals of the second region.

8. The liquid crystal display of claim 1, further comprising a plurality of second signal controllers; wherein the second region of the liquid crystal panel includes a plurality of subregions, and the plurality of second signal controllers respectively generates and transmits sub-representative values representing image signals of the plurality of subregions, to the first signal controller.

9. The liquid crystal display of claim 1, wherein the second signal controller is in unidirectional communication with the first signal controller.

10. The liquid crystal display of claim 3, wherein the first signal controller:

calculates a luminance of the first region of the liquid crystal panel and a luminance of the second region of the liquid crystal panel, compensates the image signals of the first region and the image signals of the second region in consideration of the calculated luminance of the first region and the second region, respectively, generates compensated image signals of the first region and compensated image signals of the second region, and transmits the compensated image signals of the second region to the second signal controller.

11. The liquid crystal display of claim 10, wherein the first signal controller and the second signal controller are in bidirectional communication with each other.

12. The liquid crystal display of claim 11, wherein the first signal controller and the second signal controller use an inter-integrated circuit method of communication.

13. A driving method of a liquid crystal display, the method comprising;

a first signal controller which generates a first representative value representing image signals of only a first region of a liquid crystal panel;

a second signal controller which generates and transmits a second representative value representing image signals of only a second region of the liquid crystal panel different from the first region, to the first signal controller;

calculating luminance of a light source unit which irradiates light to the liquid crystal panel, from the first representative value and the second representative value; and driving the light source unit.

14. The driving method of claim 13, wherein in the calculating luminance of a light source unit, the first signal controller calculates the luminance of the light source unit.

15. The driving method of claim 13, wherein the light source unit includes a first light source unit and a second light source unit, and in the driving the light source unit, the first light source unit irradiates light to the first region of the liquid crystal panel, and the second light source unit irradiates light to the second region of the liquid crystal panel.

16. The driving method of claim 15, wherein in the calculating luminance of a light source unit, the first signal controller calculates the luminance of the first light source unit from the first representative value, and calculates the luminance of the second light source unit from the second representative value.

17. The driving method of claim 15, wherein the calculating luminance of a light source unit includes:

the first signal controller calculating the luminance of the first light source unit from the first representative value; and the second signal controller calculating the luminance of the second light source unit from the second representative value and transmitting the calculated luminance of the second light source unit to the first signal controller.

18. The driving method of claim 13, further comprising:

converting an image signal of the first region into a first data voltage and supplying the first data voltage to the first region of the liquid crystal panel; and converting an image signal of the second region into a second data voltage and supplying the second data voltage to the second region of the liquid crystal panel.

19. The driving method of claim 13, wherein in the first signal controller generating a first representative value, at least one of a maximum value and an average value of the image signals of the first region is generated as the first representative value, and in the second signal controller generating a second representative value, at least one of a maximum value and an average value of the image signals of the second region is generated as the second representative value.

20. The driving method of claim 13, wherein the second region of the liquid crystal panel includes a plurality of subregions, a plurality of second signal controllers are connected to the first signal controller, and in the second signal controller generating a second representative value, the plurality of second signal controllers generates sub-representative values representing image signals of the plurality of subregions, and transmits the sub-representative values to the first signal controller.

21. The driving method of claim 13, wherein in the second signal controller generating a second representative value, the second signal controller transmits the second representative value to the first signal controller in unidirectional communication.

22. The driving method of claim 15, further comprising:

calculating a luminance of the first region of the liquid crystal panel and a luminance of the second region of the liquid crystal panel;

compensating the image signals of the first region and the image signals of the second region in consideration of the calculated luminance of the first region and the second region, respectively;

generating compensated image signals of the first region and compensated image signals of the second region; and transmitting the compensated image signals of the second region to the second signal controller.

23. The driving method of claim 22, further comprising:

converting the compensated image signals of the first region into compensated first data voltages and supplying the compensated first data voltages to the first region of the liquid crystal panel; and converting the compensated image signals of the second region into compensated second data voltages and supplying the compensated second data voltages to the second region of the liquid crystal panel.

24. The driving method of claim 22, wherein the first signal controller and the second signal controller exchange the second representative value and the compensated image signal of the second region in bidirectional communication.

25. The driving method of claim 24, wherein the first signal controller and the second signal controller use an inter-integrated circuit method of communication.

26. The driving method of claim 13, wherein the first signal controller generating a first representative value, the second signal controller generating and transmitting a second representative value, the calculating luminance of a light source unit and the driving the light source unit are executed in a vertical blank period.

* * * * *

UNITED STATES PATENT AND TRADEMARK OFFICE

CERTIFICATE OF CORRECTION

PATENT NO. : 9,047,828 B2
APPLICATION NO. : 13/240085
DATED : June 2, 2015
INVENTOR(S) : Kim et al.

It is certified that error appears in the above-identified patent and that said Letters Patent is hereby corrected as shown below:

On The Title Page,

Please add:

(30) Foreign Application Priority Data

Mar. 28, 2011 (KR) ..... 10-2011-0027696

Signed and Sealed this
Twenty-third Day of February, 2016

Michelle K. Lee

Michelle K. Lee
*Director of the United States Patent and Trademark Office*